US005540740A

United States Patent [19]

Yao et al.

[11] Patent Number: 5,540,740

[45] Date of Patent: Jul. 30, 1996

[54] LOW TEMPERATURE MICROEMULSION DYEING PROCESS FOR POLYESTER FIBERS

[75] Inventors: Shin-Chuan Yao; Jongfu Wu; Tsung-Wun Tsai; A-Fen Huang, all of Taipei Hsien, Taiwan

[73] Assignee: China Textile Institute, Taipei Hsien, Taiwan

[21] Appl. No.: 523,904

[22] Filed: Sep. 6, 1995

[51] Int. Cl.[6] ..... D06P 3/54

[52] U.S. Cl. ..... 8/588; 8/589; 8/611; 8/614; 8/617; 8/908; 8/909; 8/922

[58] Field of Search ..... 8/588, 589, 611, 8/614, 617, 908, 909, 922

[56] References Cited

U.S. PATENT DOCUMENTS 3,510,243 5/1970 Seuret et al. ..... 8/611

3,930,794 1/1976 Birke et al. ..... 8/611

4,715,863 12/1987 Navratil et al. ..... 8/440

*Primary Examiner*—Margaret Einsmann

*Attorney, Agent, or Firm*—Morton J. Rosenberg; David I. Klein

[57] ABSTRACT

A low temperature microemulsion dyeing process for polyester fibers includes the steps of microemulsifying a swelling agent in water to form a continuous microemulsion solution, adding dyestuff and a dye solubility assistant agent selected from the group of short chain alcohols, dyeing polyester fibers at room temperature for 1–3 hours, washing the polyester fibers with a nonionic washing agent and thereafter drying the dyed polyester fibers.

5 Claims, No Drawings

LOW TEMPERATURE MICROEMULSION DYEING PROCESS FOR POLYESTER FIBERS

BACKGROUND OF THE INVENTION

1. Field of the Invention

The present invention relates to a dyeing process for polyester fibers and, more particularly, to a low temperature microemulsion dyeing process which eliminates the need for a reducing agent in a subsequent washing step.

2. Description of Related Art

The primary goals of polyester fiber dyeing processes are the attainment of deep color and high color fastness, especially for Denil and super slender fiber fabrics.

Dyeing of polyester fibers is generally accomplished by dispersing swelling agents and dyestuffs amongst the fibers in a high temperature and high pressure environment. At temperatures above 85 degree C., which is the second transfer point of the polyester fiber, the motions of the fibers and the dyestuff molecules increase so that the dyestuff molecules are easy to diffuse among the fibers, thereby improving the dyeing process. Common practice is to employ such a dyeing process at a temperature of 130 degree C. Moreover, in such a dyeing process, organic solvents selected to swell the polyester fibers for dyeing may contain phenyl-phenol, phenyl-chloride,, phenyl-alkyl group, etc. Known high temperature and high pressure dyeing processes which employ swelling agents, however, often wash the dyed fibers with sodium hydrosulfite (as known as sodium Dithionite $Na_2SO_2O_4$) which may harm operators, residents, and the environment. A dyeing process which improves the environment of the dyeing plant, saves energy by decreasing the dyeing temperature and eliminates the need for sodium hydrosulfite is desired.

OBJECTS OF THE INVENTION

Accordingly, the primary object of the present invention is to provide a low temperature microemulsion dyeing process for polyester fibers.

It is a further object of the present invention to provide such a dyeing process which eliminates the need for washing the dyed fabric with a reducing agent.

SUMMARY OF THE INVENTION

A low temperature microemulsion dyeing process for polyester fiber is used wherein the dyeing temperature is decreased to room temperature, thereby saving energy, the peripheral environment of the dyeing plant is improved and the washing process employing a reducing agent such as sodium hydrosulfite is eliminated. At the same time, the color ratio and the washing fastness are improved. More particularly, a swelling agent selected from the group of chloromethanes is microemulsified in a dyeing solution so that the diameter of a liquid drop is between 5 to 50 nm, which is smaller than the wavelength of white light. Such a dyeing solution has the advantages of high transparency, low adhesion and high stability. Dissolution of a disperse dyestuff (dye cake) into the resolve is assisted by the addition of a short-chain alcohol dye-solubility assistant agent. Ideally, the dissolution ability is promoted to above 0.2% from 0.02%. The proper addition of short-chain alcohol, therefore, is helpful to the dissolution of the disperse dyestuff. At room temperature, the polyester fiber is swelled by the short-chain alcohol dye-solubility assistant agent, as well as by the swelling agent. Because of the effect of dye-solubility assistant agent and the disperse dyestuff, the diameter of the microemulsion liquid drop is between 5 nm and 50 nm. This is considerably smaller than that of a typical microemulsion liquid drop diameter which may be greater than 1000 nm. Under these conditions, dyestuff molecules are easily diffused into the non-crystalline region for improved dyeing.

DESCRIPTION OF THE PREFERRED EMBODIMENT

A. A low temperature microemulsion dyeing process for polyester fiber fabric includes the steps of: purification of dyestuff (step 1), preparation of a microemulsion solution (step 2), dyeing (step 3), washing (step 4), and drying (step 5). Each of these steps is detailed below.

(1) Purification of dyestuff (step 1):

A dyestuff is first treated by DME extraction before being used for removing disperse agent, is then crystallized, washed, and then dried to form a disperse dyestuff. Suitable disperse dyestuffs include disperse Red 60, disperse Yellow 54, disperse Orange 30, Dianix Yellow AC-E, Dianix Red AC-E, Dianix Blue AC-E, Foron Red E-2Gl, E or SE type, and other disperse dyestuffs.

(2) Preparation of microemulsion solution (step 2):

The microemulsion solution contains:

(a) swelling agent (selected from the group of chloromethanes) . . . 1–15%

(b) short-chain alcohol ($C_nH_{2n+1}OH$, n=2–5) dye-solubility assistant agent . . . 2–30%

(c) anionic microemulsion solution (R—O—$SO_3Na$) [R=alkyl or aryl] . . . 1–5%; and, (d) water . . . 50–95%.

The microemulsion dyeing solution contains an oil phase, an emulsifying solvent/dye-solubility assistant agent and a water phase. The dyestuff is added according to its density. The oil phase contains a polyester fiber swelling agent chosen from the group of chloromethanes. The dye-solubility assistant agent (CO-SURFACTANT) is formed from a short-chain alcohol chosen from the group ($C_nH_{2n+1}OH$, n=2–5).

(3) Dyeing (step 4):

The polyester fiber swelling agent, the short-chain alcohol dye-solubility assisting agent, the anion microemulsion agent and the disperse dyestuff are combined and stirred for microemulsification. Fiber are dyed at room temperature (20–30 degree C.), for 1–3 hours, the bath ratio being 1:20–1:50. Fabrics to be dyed include polyester Denil fiber fabric and T/N super slender blend fiber fabric, each having the following properties:

(a) polyester Denil fiber fabric:

$$\frac{140 \times 180}{75D/72f \times 15550D/288f}\text{; and,}$$

(b) *T/N* super slender blend fiber fabric:

$$\frac{158 \times 84}{75D/72f \times 50D/72 \times 12f}.$$

(4) Washing (step 4):

After dyeing, the microemulsion solution is washed at a temperature of 50–60 degrees C. for 20–60 minutes using a non-ionic washing agent having a density of 2–10 g/l, so that the dyestuff and other agents can be removed. Generally, the non-ionic washing agent contains aromatics, polyester or other non-ionic interface activators for polyester.

(5) Drying (step 5):

The microemulsion solution is dried at a temperature of 110–130 degree C., for 10–30 minutes, in order to remove the residual swelling agent and dye-solubility assistant agent.

From the above detailed description, a low-temperature microemulsion dyeing process for polyester fibers is obtained.

EXAMPLE 1

In this example, a Denil polyester fiber was dyed with Dianix Yellow AC-E.

(1.) Purification of the dyestuff was attained as described in step 1 above.

(2.) Preparation of microemulsion solution (step 2):

The microemulsion dyeing solution contained:

(a) Dye: Dianix Yellow AC-E . . . 1.5% o.w.f. (dye cake);

(b) Swelling agent . . . 1–15 g;

(c) Microemulsion agent . . . 1–15 g;

(d) Dye-solubility assistant agent . . . 2–30 g; and, (e) Water . . . 50–90 g.

1–15% of emulsion agent was dissolved in 50–90 g water. Stirring while adding 2–30 g of short-chain alcohol and 1–15 g of chloro-swelling agent, the solvent gradually became transparent. 1–4% o.w.f. of disperse dyestuff and dye cake were then added to the microemulsion solution, stirring until a steady, uniform and transparent microemulsion dyeing solution was formed.

(3) Dyeing

Before dyeing, the polyester Denil fiber fabric and T/N super slender blend fiber fabric were de-sized, refined and whitened. The T/N super slender blend fiber fabric was treated first. The bath ratio of the prepared dyeing solution was 1:20 to 1:50. The treated polyester Denil fiber fabric and T/N super slender blend fiber fabric were dyed at 20–30 degree C. for 1–3 hours.

The type of Denil polyester fabric used was:

$$\frac{140 \times 180}{75D/72f \times 15550D/288f}$$

(4) Washing

After dyeing, the liquid was drained, and then the fabrics were treated by a washing agent having a density of 2–10 g/l, at a temperature of 50–60 degrees C., for 20–60 minutes.

(5) Drying

After washing, the fabrics were dried at a temperature of 110–130 degree C., for 10–30 minutes.

The low temperature microemulsion dyeing of the polyester fiber fabric was thus performed without using a reducing agent in the washing process.

The color of the present embodiment was measured by an ASC spectrometer. The color fastness was measured by AATCC II A method.

EXAMPLE 2

In this example T/N super slender polyester fiber was dyed with Dianix Yellow AC-E.

(1) The processing method in this example was the same as in steps 1–5 of Example 1.

(2) The components used in the microemulsion dyeing solution were the same as those used in Example 1.

(3) The type of T/N blend super slender fabric used was:

$$\frac{158 \times 84}{75D/72f \times 150D/72 \times 12f}$$

EXAMPLE 3

In this example, Danil polyester fiber was dyed with Dianix Red AC-E.

(1) The processing method in this example was the same as in steps 1–5 of Example 1.

(2) The components used in the microemulsion dyeing solution were the same as those used in Example 1.

(3) The type of fabric used was the same as that used in Example 1.

(4) Dye cake: Dianix Red AC-E 1.5% o.w.f.

EXAMPLE 4

In this example, T/N super slender polyester fiber was dyed with Dianix Red AC-E.

1. The processing method and the components of the dye solution and dye cake were the same as those used in Example 3.

2. The type of T/N super slender blend polyester fabric used was:

$$\frac{158 \times 84}{75D/72f \times 150D/72 \times 12f}.$$

A. PRIOR ART EXAMPLE 1 FOR COMPARISON TO EXAMPLE 1 (COMPARED EX.1)

(1) The microemulsion dyeing solution contained:

a. Dye: Dianix Yellow AC-E . . . 5% o.w.f.

b. Swelling agent . . . 4.0 g c. Dispersing agent . . . 1 g d. pH adjusting agent (glacial acetic acid) . . . 0.25 g e. Sodium Acetate . . . 1.0 g (2) The following reducing washing agent was required:

sodium hydrosulfite . . . 1.5 g/l

NaOH . . . 2.0 g/l

Washing agent . . . 1.0 g/l (3) The type of Denil polyester fabric used was:

$$\frac{140 \times 180}{75D/72f \times 15550D/288f}$$

PRIOR ART EXAMPLE 2 FOR COMPARISON TO EXAMPLE 2 (COMPARED EX.2)

(1) The components were the same as those used for prior art example 1, except that:

The type of T/N super slender blend polyester fabric used was:

$$\frac{158 \times 84}{75D/72f \times 150D/72 \times 12f}$$

PRIOR ART EXAMPLE 3, FOR COMPARISON TO EXAMPLE 3 (COMPARED EX.3)

1. The components were the same as those used for prior art example 1, except that:

The dye used was Dianix Red AC-E 5% o.w.f. (dye cake).

PRIOR ART EXAMPLE 4, FOR COMPARISON TO EXAMPLE 4 (COMPARED EX.4)

1. The components and organization were the same as those used in prior art example 2, except that:

The dye used was Dianix Red AC-E 5% o.w.f. (dye cake).

For each of the above examples, the dyeing product was tested for washing fastness by AATCC II A method and the K/S value was tested by ASC an spectrometer. The test results are listed in Table I

| process | fabric | dyestuff | k/s | washing fastness |
|---|---|---|---|---|
| EXAMPLE 1 | Danil PET | Dianix Yellow AC-E 1.5% o.w.f. (dye cake) | 13.48 | 4 |
| compared ex. 1 | Danil PET | Dianix Yellow AC-E 1.5% o.w.f. (dye cake) | 11.06 | 4 |
| EXAMPLE 2 | T/N superslender fiber | Dianix Yellow AC-E 1.5% o.w.f. (dye cake) | 9.10 | 3.5 |
| compared ex. 2 | T/N superslender fiber | Dianix Yellow AC-E 5% o.w.f. (dye cake) | 7.02 | 3.5 |
| EXAMPLE 3 | Danil PET | Dianix Red 7 AC-E 1.5% o.w.f. (dye cake) | 8.19 | 4 |
| compared ex. 3 | Danil PET | Dianix Red AC-E 5% o.w.f. (dye cake) | 8.12 | 3.5 |
| EXAMPLE 4 | T/N superslender fiber | Dianix Red AC-E 1.5% o.w.f. (dye cake) | 5.84 | 3.5 |
| compared ex. 4 | T/N superslender fiber | Dianix Red AC-E 5% o.w.f. (dye cake) | 5.81 | 3 |

From the results listed above, it can be appreciated that the k/s value of microemulsion dyeing at room temperature and the washing fastness are better than that obtainable using a dye-solubility swelling agent at 100 degree C. Not only is the dyeing temperature decreased, but the peripheral environment of the dyeing plant is improved, the reducing agent washing step is eliminated and the process of the present invention provides a preferred dyeing effect.

Besides Dianix Yellow AC-E, Red AC-E, other suitable microemulsion dyeing materials are Disperse Red 60, Dianix Blue AC-E, Foron Red E-2GL, Disperse Yellow 54, Disperse Orange 30 and other disperse dyestuff.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended Claims.

What is claimed is:

1. A low temperature microemulsion dyeing process for polyester fibers, comprising the steps of:

Microemulsifying a swelling agent, a dye-solubility assistant and an anionic emulsion agent in water to form a microemulsion solution and adding dyestuff;

wherein the dye-solubility assistant agent is selected from the group of short-chain alcohols;

Dyeing the polyester fibers at room temperature for 1–3 hours;

Washing the dyed polyester fibers; and,

Drying the dyed polyester fibers.

2. The low temperature microemulsion dyeing process for polyester fibers as claimed in claim 1, wherein said microemulsion dyeing solution consists of:

1–15% of said swelling agent, selected from the group of chloromethanes;

2–30% of said dye-solubility assistant agent, selected from the group of short-chain alcohols $C_n H_{2n+1}OH$, n=2–5;

1–15% of an anionic emulsion agent R—O—$SO_3$Na, R=alkyl or aryl; and,

50–95% of water.

3. The low temperature microemulsion dyeing process for polyester fibers as claimed in claim 1, wherein Said dyeing step is performed at a temperature of 20–30 degree C. for 1–3 hours and, a bath ratio of 1:20 to 1:50.

4. The low temperature microemulsion dyeing process for polyester fibers as claimed in claim 1, wherein:

Said washing step is performed at a temperature of 50–60 degree C. for 20–60 minutes using a non-ionic agent having a density of 2–10 g/l.

5. The low temperature microemulsion dyeing process for polyester fibers as claimed in claim 1, wherein said drying step is performed at a temperature of 100–130 degree C. for 10–30 minutes.

* * * * *